US005972429A

United States Patent [19]

Bayer et al.

[11] Patent Number: 5,972,429

[45] Date of Patent: Oct. 26, 1999

[54] CHROMIUM-SILICON DIFFUSION COATING

[75] Inventors: George T. Bayer, Tarentum, Pa.; Kim A. Wynns, Spring, Tex.

[73] Assignee: Alon, Inc., Tarentum, Pa.

[21] Appl. No.: 08/962,753

[22] Filed: Nov. 3, 1997

Related U.S. Application Data

[63] Continuation-in-part of application No. 08/713,158, Sep. 12, 1996.

[51] Int. Cl.[6] ..... C23C 16/22

[52] U.S. Cl. ..... 427/253; 427/252; 427/229

[58] Field of Search ..... 427/229, 237, 427/252, 253

[56] References Cited

U.S. PATENT DOCUMENTS

| | | | |
|---|---|---|---|
| 3,779,719 | 12/1973 | Clark et al. | 427/253 |
| 4,687,684 | 8/1987 | Restall et al. . | |
| 4,904,501 | 2/1990 | Davis . | |
| 5,135,777 | 8/1992 | Davis et al. . | |
| 5,364,659 | 11/1994 | Rapp et al. . | |
| 5,441,767 | 8/1995 | DeSaulniers | 427/253 |
| 5,492,727 | 2/1996 | Rapp et al. | 427/252 |
| 5,589,220 | 12/1996 | Rapp et al. . | |

FOREIGN PATENT DOCUMENTS

| | | |
|---|---|---|
| 1 221 455 | 6/1960 | France . |
| 586 241 | 3/1947 | United Kingdom . |
| 961 020 | 6/1964 | United Kingdom . |

OTHER PUBLICATIONS

Derwent Abstract SU 983 151 A, A. F. Goncharov, Dec. 23, 1982.

Derwent Abstract SU 1 659 529 A, Belo Powder Metal Res. Production Association, Dec. 7, 1982.

Derwent Abstract SU 979 524 A, Belorussian Poly., Dec 7, 1982.

Derwent Abstract SU 589 287 A, Cherp University, Jan. 12, 1978.

Derwent Abstact SU 1 557 194 A, O. V. Kasparova, Apr. 15, 1990.

"Thermodynamics and Kinetics of Pack Cementation Processes" by Leslie L. Seigle, *Surface Engineering Modification of Materials,* 1984, Martinus Nijhoff Publishers, pp. 345–369.

*Primary Examiner*—Shrive Beck
*Assistant Examiner*—Bret Chen
*Attorney, Agent, or Firm*—Buchanan Ingersoll, P.C.

[57] ABSTRACT

A method of diffusion coating a surface of an alloy product containing at least 5 wt. % iron with a chromium-silicon coating uses a dual activator containing a fluoride salt and a chloride salt, at least one of those salts particularly being ammonium chloride or another ammonium halide salt. The pack mix contain at least 20% chromium and a chromium to silicon ratio of at least 10 to 1. The workpiece is heated to at least 2050° F. to obtain a coating of at least 10 mils which contains at least 30% chromium. Upon heating the ammonium salt will form a reducing environment containing molecular hydrogen. The presence of molecular hydrogen speeds up the chemical reactions by an additional reduction reaction to create the surface coating which enables the coating reactions to occur shorter hold times.

17 Claims, 1 Drawing Sheet

CHROMIUM-SILICON DIFFUSION COATING

CROSS REFERENCE TO RELATED APPLICATION

This is a continuation-in-part of U.S. patent application Ser. No. 08/713,158, filed Sep. 12, 1996.

FIELD OF INVENTION

The invention relates to a method for producing a chromium-silicon containing coating diffused onto the surface of alloys containing at least 5 wt. % iron to provide improved resistance to high-temperature corrosion, erosion, and wear.

BACKGROUND OF THE INVENTION

Pack cementation is a well known chemical vapor diffusion technique for applying diffusion coatings to metal surfaces. This process involves placing a pack mixture into close contact with the surface being coated and subsequently heating the entire assembly to an elevated temperature for a specified period of time. During heating the coating material diffuses from the pack onto the surface of the metal by a combination of chemical reactions and gas phase mass transport. A common pack mixture used to create a chromium coating contains chromium, an inert filler such as alumina, and a halide activator. Davis in U.S. Pat. No. 4,904,501 teaches that ammonium chloride, sodium chloride and ammonium bromide can be used as activators. Clark et al. in U.S. Pat. No. 3,779,729 disclose a diffusion coating for jet engine components applied using a pack mix. Depending upon the desired coating the pack may contain aluminum, chromium, silicon or combinations of these elements. The reference further teaches that a trace amount of activator ranging from 0.1 to 3 percent by weight be used. According to the patent this activator is generally a halogen or halogen precursor compound. Fluorine, chlorine, bromine and iodine per se and in salt form, particularly alkali and alkaline earth metal and ammonium salt forms are said to be examples of acceptable activators. However this patent does not teach or suggest that any one activator would perform differently from another and does not even identify the halogen activator used in the examples. The most common practice followed by Davis, Clark et al. and others is to use a single activator.

Some dual chloride and fluoride activator systems have also been proposed to enhance the ability to co-deposit both chromium and silicon. Rapp et al. in U.S. Pat. No. 5,492,727 disclose that in dual activator Cr-Si cementation packs containing a chloride and a fluoride dual activator the chlorine primarily increases the vapor pressure of chromium gaseous species, and the fluorine primarily increases the vapor pressure of silicon gaseous species. Therefore, by adjusting the ratio between chloride and fluoride in a dual activator approach, one can achieve different proportions of chromium-silicon in the coating. Yet, the data they present does not show how this might be accomplished. Rapp et al. use only one dual activator: $90MgCl_2$–10 NaF. Their data shows that the amount of chromium-silicon in the coating varies among different substrates when that one dual activator is used. Rapp et al. also teach that a desired Cr-Si diffusion coating will contain 25–30 wt. % Cr and 3–4 wt. % Si. They say that to achieve that desired result requires an exact control of the fluxes of Cr and Si from the pack to the steel during the coating process. Yet, they do not teach how to perform that control. All of the pack mixes in their example contain the same ratio and amount of these elements, namely 20% Cr and 2% Si. Finally, Rapp et al. teach that a two step heating process, first at 925° C. and then at 1150° C. should be used. However, it is preferable to have a single heating step.

Two significant users of chromium-silicon coated metal products are the power generation industry and the petrochemical processing industry. Those users often demand chromium-silicon coated parts having a coating thickness of at least 10 mils and at least 30% chromium in the coating. As can be seen from tests reported herein, the process described in the Rapp '727 patent will not produce a coating that meets this specification.

Rapp and Harper in U.S. Pat. No. 5,364,659 disclose a pack cementation process for co-depositing chromium and silicon on an iron base workpiece using a chromium-silicon masteralloy and a dual halide activator of sodium fluoride and sodium chloride. In this process the workpiece is heated to between 800° C. and 1200° C. (1472° F., to 2192° F.) for a sufficient time to deposit a coating of chromium and silicon on the workpiece. The examples discussed in the patent were heated for 16 or 20 hours. This method is not commercially acceptable for several reasons. Use of a chromium-silicon masteralloy as a chromium and silicon source is more expensive than using pure chromium/silicon or ferrochromium/ferrosilicon. Second, our test results reported herein show that a coating thickness of 10 mils cannot be achieved and the silicon content of the resultant coating is very low. Consequently, there is a need for an effective chromium-silicon diffusion coating process which operates at a single process temperature and creates a coating of at least 10 mils thickness and containing at least 30% chromium.

SUMMARY OF THE INVENTION

We provide a method of diffusion coating an alloy containing at least 5 wt. % iron with a chromium-silicon coating using a dual activator containing a fluoride salt and a chloride salt at least one of those salts being of an ammonium type. The pack mix should contain greater than 15 wt. % chromium, preferably 25 wt. % chromium, and the Cr:Si ratio in the pack mix should be greater than 7.5:1 and preferably greater than 10:1. Furthermore, the workpiece should be heated to at least 2050° F. (1093° C.) and preferably to 2100° F. (1149° C.). Upon heating the ammonium salt will provide resultant molecular hydrogen. The presence of molecular hydrogen speeds up the chemical reactions that create the surface coating by introducing an additional reduction reaction, which enables the coating reactions to occur at shorter hold times.

DESCRIPTION OF THE PREFERRED EMBODIMENTS

Figure 1:
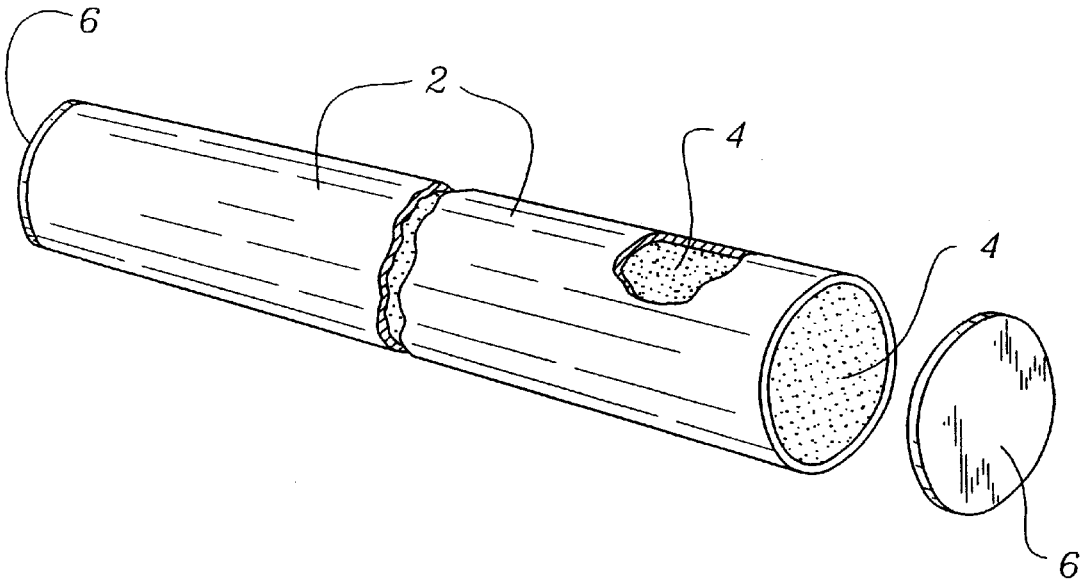
FIG. 1 is a perspective view partially cut away of a tube containing a pack for applying a chromium-silicon coating in accordance with a first preferred embodiment of our method.

We provide a method of applying a chromium-silicon diffusion coating on a surface of an alloy containing at least 5 wt. % iron. In a first preferred embodiment of our method we use a dual activator containing a fluoride salt and a chloride salt at least one of those salts being of an ammonium type. Although the method could be used to coat both sheet and tubular stock, in FIG. 1 we illustrate the method as used in pack cementation to coat tubes and pipes. In the illustrated process the tubes and pipes are provided with a diffusion coating on their inner wall. It should be understood however that our method is not limited to pack cementation and can be used in other diffusion techniques such as masteralloy-activator-filler composite inserts and sheets. Referring to FIG. 1 we illustrate a tube or pipe 2 which can be of any desired length and may include both straight portions and return bends. The tube is filled with a pack mix composition 4 having a dual activator containing a fluoride salt and a chloride salt at least one of those salts being of an ammonium type. The pack mix also contains pure chromium metal or a ferro-chromium alloy, pure silicon metal or a ferro-silicon alloy and a filler such as aluminum oxide. If a ferro-chromium alloy is used as the chromium source, a ferro-silicon alloy should be used as the silicon source. The ends of the tube are closed by caps 6 and the tube is heated in a retort furnace to cause the ammonium salt to decompose forming a reducing environment and to allow chromium and silicon to diffuse onto the surface of the iron-containing alloy product forming a chromium-silicon coating.

The advantage to using ammonium chloride as an activator in this chromium-silicon diffusion coating process is that ammonium chloride decomposes at 399° C. (642° F.) to form ammonia and hydrogen chloride. Upon further temperature increases, the ammonia cracks to form nitrogen and hydrogen. Two benefits are evident. First, the hydrogen chloride generated increases the overall chemical reactivity of the pack increasing the rate of formation of both volatile chromium-silicon chloride species which are transported to the substrate surface and deposit chromium-silicon via chemical reaction and gas phase mass transport.

Second, the hydrogen generated allows for an additional reduction reaction at the substrate surface causing a more rapid decomposition of the chromium and silicon chlorides and fluorides and thus a more rapid deposition of chromium and silicon metal onto the substrate. Also, the reducing atmosphere keeps the substrate free of diffusion limiting oxides. This has been discussed previously in a study of the thermodynamics and kinetics of pack cementation processes in "Thermodynamics and Kinetics of Pack Cementation Processes," by L. L. Seigle, *Surface Engineering,* Martinus Niehoff Publishers, Dordrecht, 1984, pp. 345–369.

Calcium fluoride is an effective second activator because the presence of fluoride improves the coating process by increasing the silicon content of the coating.

To provide the desired corrosion resistance we have found that a chromium-silicon coating should contain at least 30 wt. % chromium and at least 1 wt. % silicon. This is consistent with the teaching of Rapp et al. in U.S. Pat. No. 5,492,727. We also found that the diffusion coating must be at least 250 microns (10 mils) thick to be acceptable to the power generation and chemical process industries. Therefore, we investigated several chromium-silicon pack mixes to find a dual activator pack mix and process temperatures which would produce the desired coating.

The first set of experiments which produced the results reported in Table 1 were conducted in a 12"×12"×24" carbon steel retort containing 2"×2"×⅛ type 1018 carbon steel coupons packed in the powder mix, with an inert argon atmosphere provided to the retort. The heating cycle consisted of heat up of the retort in a gas fired furnace to at least 1160° C. (2120° F.) at which point the temperature was held at 1160°–1190° C. (2120°–2175° F.) for twelve (12) hours, followed by as rapid a cooling cycle as possible. Sample coupons from each experiment were cut, mounted, and polished according to standard metallographic procedures. Additionally, promising samples were subjected to scanning electron microscopy/energy dispersive spectrometry to determine surface chromium-silicon composition of the diffusion coatings.

The results of these experiments are set forth in Table 1.

TABLE 1

| | Powder (wt. %) | Diffusion Coating | | | |
|---|---|---|---|---|---|
| Sample | Composition | Depth (mils) | % Cr | % Si | Notes |
| R-092 | 25Cr, 3Si, 2NaCl, bal. $Al_2O_3$ | 1.6 | not determined | | |
| R-105 | 25 Cr, 3Si, 2NaCl, $2CaF_2$, bal. $Al_2O_3$ | 9.6 | 8.3 | 2.0 | |
| R-116 | 25Cr, 3Si, $2NH_4Cl$, $2CaF_2$, bal. $Al_2O_3$ | 12.2 | 33.5 | 1.4 | |
| R-139-1 | 25Cr, 2Si, $2NH_4Cl$, bal. $Al_2O_3$ | 16–20 | 13.3 | 4.9 | |
| R-139-2 | 25Cr, 2Si, $1NH_4Cl$, $1CaF_2$, bal. $Al_2O_3$ | 15–17 | 51.2 | 4.7 | |
| R-139-3 | 25Cr, 2Si, 2NaCl, bal. $Al_2O_3$ | 6–10 | 23.1 | 4.8 | 1 |
| R-139-4 | 25Cr, 2Si, 1NaCl, $1CaF_2$, bal. $Al_2O_3$ | 17–18 | 54.6 | 2.6 | |
| R-139-5 | 25Cr, 2Si, $2CaF_2$ bal. $Al_2O_3$ | 2–3 | 7.2 | 4.9 | 2 |

Notes: 1 = excessive porosity and surface non-uniformity, 2 = grain boundaries running through entire thickness of coating Thus, it is apparent that calcium fluoride $CaF_2$ alone and sodium chloride NaCl alone do not serve as a suitable activator. When NaCl is combined with $CaF_2$, a suitable coating was achieved with 2% silicon in the pack mix but not with 3% silicon. Yet, the ammonium ride activator combined with calcium fluoride produced an acceptable coating at both 2% 3% silicon. When used alone the ammonium chloride activator produced a coating having low chromium. Hence, a dual activator system containing an ammonium salt consistently produced a acceptable coating when heated for 12 hours at 2120°–2175° F.

A second study was made in an effort to quantify the effects upon coating thickness of varying the chromium and silicon content. Pack mixes containing varying amounts of chromium and silicon with 1 wt. % $NH_4Cl$ and 1 wt. % $CaF_2$ were applied to the ID surfaces of ASTM A53 1"IPS schedule 80 carbon steel pipe and heated at 1150°–1175° C. (2100°–2150° F.) for 12 hours in an argon atmosphere, in a 14"×14"–24" carbon steel retort. Carbon steel caps were tack welded on the ends of each tube. The coating depth was measured by optical metallography. The results are shown in Table 2.

TABLE 2

| | Pack Mix | | | |
|---|---|---|---|---|
| Sample | % Cr | % Si | Cr:Si Ratio | Coating Depth (mils) |
| 1 | 20 | 2 | 10 | 11–15 |
| 2 | 20 | 1 | 20 | 2.5–3.5 |
| 3 | 20 | 0.5 | 40 | 1.5–2 |
| 4 | 15 | 2 | 7.5 | 4–8 |
| 5 | 15 | 1 | 15 | 3–5 |
| 6 | 15 | 0.5 | 30 | 1.5–2 |
| 7 | 10 | 2 | 5 | 3.5–6 |
| 8 | 10 | 1 | 10 | 1–2 |
| 9 | 10 | 0.5 | 20 | <1 |

We observed that all coatings prepared using pack mixes with a Cr:Si ratio of 7.5:1 or less contained excessive porosity. Only Sample 1 which contained 30% chromium and had a 10:1 Cr:Si ratio produced a coating thickness of at least 10 mils.

Another study was conducted to determine if acceptable coatings could be obtained using the activator mix compositions disclosed in U.S. Pat. No. 5,364,659 to Rapp and Harper and those disclosed in U.S. Pat. Nos. 5,492,727 and 5,589,220 to Rapp et al. The '659 patent teaches that a chromium-silicon masteralloy should be used and heated to between 800° C. (1472° F.) and 1200° C. (2192° F.). The Rapp et al. '727 patent teaches but used compositions with the same chromium, silicon and activator content that they disclose. We also tested our preferred activator system. These experiments were also conducted in a 14"×14"×24" carbon steel retort containing ASTM A53 1" IPS schedule 80 carbon steel pipe with powder mix packed on the ID surfaces with an inert argon atmosphere provided in the retort. Samples of each powder mix were tested at 1925° F. (1052° C.), 2100° F. (1149° C.) and at dual heating initially at 1700° F. (927° C.) and then at 2100° F. (1149° C.). The results of the test are shown in Table 3. Samples A, B, C, P, Q and R use compositions disclosed in U.S. Pat. No. 5,364,659 although only samples A. B and C were heated at the temperature taught by this reference. Samples H, I, J, K, S, T, U and V are compositions disclosed in U.S. Pat. Nos. 5,492,727 and 5,589,220 to Rapp et al. although only samples H, I, J and K were heated using the two step heating process that these inventors disclose. The other samples use mix compositions containing a dual activator, one of which is an ammonium halide salt.

TABLE 3

| Sample | Mix Composition | Temp. (F.) | Time (Hrs.) | Diffusion (mils) | Surface Cr—Si (Wt. %) |
|---|---|---|---|---|---|
| A | 23(90Cr—10Si), 75$SiO_2$, 2NaCl | 1925 | 16 | 2–4 | 83.7–1.8 carbide |
| B | 23(90Cr–10Si), 75$SiO_2$, 2NaF | 1925 | 16 | 2.5–6.5 | 88.0–1.4 carbide |
| C | 23(90Cr—10Si), 75$SiO_2$, 2(95 NaF—5NaCl) | 1925 | 16 | 4.5–8 | 86.7–0.6 (carbide) |
| D | 25Cr, 2Si, 71 $Al_2O_3$, 1$NH_4Cl$, $CaF_2$ | 1925 | 16 | 3.5–5 | 93.6–0.8 (carbide) |
| E | 25FeCr, 2FeSi, 71$Al_2O_3$, 1$NH_4Cl$, 1$CaF_2$ | 1925 | 16 | 1–2.5 | 29.4–5.9 |
| F | 20Cr, 2Si, 76$Al_2O_3$, 1$NH_4Cl$, 1$CaF_2$ | 1925 | 16 | 3.5–4 | 4.1–7.3 |
| G | 20FeCr, 2FeSi, 76$Al_2O_3$, 1$NH_4Cl$, 1$CaF_2$ | 1925 | 16 | 1–2 | 8.7–5.5 |
| H | 20Cr, 2Si,76 $Al_2O_3$,2$MgCl_2$ | 1700/2100 | 8/4 | 0.5–1 | 87.7–3.1 (carbide) |
| I | 20Cr, 2Si, 76 $Al_2O_3$, 2NaCl | 1700/2100 | 8/4 | 0–0.5 | 7.3–2.2 |
| J | 20Cr, 2Si, 76$Al_2O_3$, 2$NH_4Cl$ | 1700/2100 | 8/4 | 0.5–2 | 96.7–0.4 (carbide) |
| K | 20Cr, 2Si, 76$Al_2O_3$, 2(90$MgCl_2$, 10NaF) | 1700/2100 | 8/4 | 0.5–1 | 94.6–0.5 (carbide) |
| L | 25Cr, 2Si, 71 $Al_2O_3$, 1$NH_4Cl$, 1$CaF_2$ | 1700/2100 | 8/4 | 5–7 | 65.5–1.4 (carbide) |
| M | 25FeCr, 2FeSi, 71$Al_2O_3$, 1$NH_4Cl$, 1$CaF_2$ | 1700/2100 | 8/4 | 0.5–1 | 84.0–0.4 (carbide) |
| N | 20Cr, 2Si, 76$Al_2O_3$, 1$NH_4Cl$, 1 $CaF_2$ | 1700/2100 | 8/4 | 4.5–5 | 75.8–0.4 (carbide) |

TABLE 3-continued

| Sample | Mix Composition | Temp. (F.) | Time (Hrs.) | Diffusion (mils) | Surface Cr—Si (Wt. %) |
|---|---|---|---|---|---|
| O | 20FeCr, 2FeSi, 76$Al_2O_3$, 1$NH_4Cl$, 1$CaF_2$ | 1700/2100 | 8/4 | 0–0.5 | 82.6–0.3 (carbide) |
| P | 23(90Cr—10Si), 75 $SiO_2$, 2NaCl | 2100 | 12 | 12–16 | 15.9–4.0 |
| Q | 23(90Cr—10Si), 75$SiO_2$, 2NaF | 2100 | 12 | 14–18 | 1.0–4.2 |
| R | 23(90Cr—10Si), 75$SiO_2$, 2(95 NaF—5NaCl) | 2100 | 12 | 12–15 | 2.6–3.0 |
| S | 20Cr, 2Si, 76 $Al_2O_3$, 2$MgCl_2$ | 2100 | 12 | 10–12 | 29.2–4.1 |
| T | 20Cr, 2Si, 76 $Al_2O_3$, 2NaCl | 2100 | 12 | 4–6 | 21.2–1.3 |
| U | 20Cr, 2Si, 76 $Al_2O_3$, 2$NH_4Cl$ | 2100 | 12 | 6–10 | 88.4–0.4 (carbide) |
| V | 20Cr, 2Si, 76$Al_2O_3$, 2(90$MgCl_2$, 10NaF) | 2100 | 12 | 12–16 | 25.6–3.3 |
| W | 25Cr, 2Si, 71 $Al_2O_3$, 1$NH_4Cl$, 1$CaF_2$ | 2100 | 12 | 16–18 | 51.2–4.7 |
| X | 25FeCr, 2FeSi, 71$Al_2O_3$, 1$NH_4Cl$, 1$CaF_2$ | 2100 | 12 | 8–10 | 37.6–1.7 |
| Y | 20Cr, 2Si, 76 $Al_2O_3$, 1$NH_4Cl$, 1$CaF_2$ | 2100 | 12 | 16–18 | 23.4–3.9 |
| Z | 20FeCr, 2FeSi, 76$Al_2O_3$, 1$NH_4Cl$, 1$CaF_2$ | 2100 | 12 | 8–10 | 35.8–1.5 |

This data indicates that coatings of 10 mils or greater are not achieved for any of the mix compositions when the sample is heated at 1925° F. or using 1700° F. and 2100° F. Nearly all samples heated at 2100° F. for 12 hours produced coating thickness of 10 mils or more. Although the ferro-chromium systems of samples X and Z had thinner coatings, thicker coatings could be created by increasing the time or temperature. Only our dual activator systems having an ammonium halide salt activator and heated at 2100° F. (1149° C.) produced coatings of 10 mils or greater containing 30% chromium. In this group Sample Y had the lowest chromium content in the mix and produced the lowest chromium content in the coating. In samples X and Z the ferro-chromium had a composition of 70% chromium by weight and ferro-silicon contained 50% silicon by weight so the Cr:Si ratio is 17.5:1 and 14:1, respectively.

In an effort to define the temperature change required to produce a coating of at least 10 mils and containing at least 30% chromium we tested the mix of sample W at heating temperatures of 1950° F. (1065° C.,), 2000° F. (1093° C.) and 2050° F. (1121° C.). This mix was placed upon 2"×2"⅛" 1080 carbon steel coupons and placed in a 12"×12"×24 retort. The results of that test are reported in Table 4.

TABLE 4

| Mix Composition | Temp. (F.) | Time (hrs.) | Diffusion (mils) | Surface Cr—Si (Wt. %) |
|---|---|---|---|---|
| 25Cr, 2Si, 75$Al_2O_3$, 1$NH_4Cl$, 1$CaF_2$ | 2050 | 12 | 13–14 | 33.5–2.2 |

TABLE 4-continued

| Mix Composition | Temp. (F.) | Time (hrs.) | Diffusion (mils) | Surface Cr—Si (Wt. %) |
|---|---|---|---|---|
| 25Cr, 2Si, $75Al_2O_3$, $1NH_4Cl$, $1CaF_2$ | 2000 | 12 | 11–13 | 24.4–5.5 |
| 25Cr, 2Si, $75Al_2O_3$, $1NH_4Cl$, $1CaF_2$ | 1950 | 12 | 10–12 | 14.8–6.7 |

From this data we see that all three temperatures provide a coating of at least 10 mils. However, only the sample heated at 2050° F. produced a coating having at least 30% chromium. Hence, we conclude that a temperature of at least 2050° F. is needed to produce the desired coating. Temperatures lower than 2050° F. favor increasing silicon content while reducing chromium content below acceptable levels.

Based upon the test results we concluded that three factors are important to consistently achieve a coating of at least 10 mils which contains 30% chromium or higher. First a chromium-silicon pack mix should contain a dual activator containing a chloride salt and a fluoride salt. One of these salts should be an ammonium chloride salt. Second, the Cr:Si in the mix ratio should be greater than 10:1. Finally, the mix should be heated to at least 2050° F. If a coating of at least 10 mils and a chromium content below 30% is desired, the mix could be processed at temperatures as low as 1950° F.

An acceptable pack mixture consists of either 20–25 wt. % chromium or ferro-chromium, 1–3 wt. % silicon or ferro-silicon, 0.5–2 wt. % ammonium chloride and 0.5–2 wt. % fluoride salt ($CaF_2$, NaF, $MgF_2$, KF, etc.) activator combination with the balance being inert aluminum oxide filler.

To practice our method we prefer that the components to be chromium-silicon diffusion coated are placed in a carbon steel or high-temperature alloy retort and are surrounded by the pack mix. The retort lid is then welded on, or hermetically sealed. Pure argon or argon plus up to 5 vol. % hydrogen is used as the purge gas to provide an inert or reducing atmosphere. The retort may first be heated to between 300°–400° F. (169°–204° C.) for at least one hour to remove any oxygen or moisture present. After this is completed, the retort is heated in a single step to an interior temperature of 2050° F. to 2200° F., or between 1120° C. and 1200° C., at this temperature for a period dependent on the base alloy composition and required diffusion depth. After the high-temperature hold time is completed, the retort is cooled as rapidly as possible, opened, and the chromium-silicon diffusion coated components are thoroughly cleaned and neutralized with a pH 11–14 alkaline solution to chemically render harmless any residual halide species present.

When using large retorts, the entire retort does not need to be filled completely with pack mix. As long as the components to be diffusion coated are immersed in at least one inch of pack mix, a protective covering of inert and heat resistant ceramic or metal sheeting may be applied to the top surface of the pack mix to hold it in place and processing will be performed as described above. This will result in an inert/reducing gas dead space above the pack and since less powder is used than in a fully packed retort, improved heat transfer to the pack components will be achieved. As an alternative to a pack mix, a masteralloy-activator-filler composite sheet containing the proper proportions of chromium/ferro-chromium, silicon/ferro-silicon, halide activators, aluminum oxide, and binder may be laid in the retort adjacent to the components to be coated and processing will be performed as described above.

When only the inside surface of tubes and pipes need to be diffusion coated, it is possible to pack only these inside surfaces with pack mix, held in place by metal caps or a high temperature adhesive tape. The packed tubes and pipes can then be loaded into an empty retort and processing will be performed as described above. Since powder is only present in the tubes and pipes, improved heat transfer to them will be achieved. As an alternative to a pack mix, a masteralloy-activator-filler composite insert containing the proper proportions of chromium/ferro-chromium, silicon/ferro-silicon, halide activators, aluminum oxide, and binder may be loaded into the tubes and pipes, capped/taped, and processing will be performed as described above.

An additional post-diffusion heat treatment step may be added for either of the purposes of surface preoxidation or to precipitate dispersed chromium carbides for improved erosion and wear resistance.

While we have described and illustrated certain present preferred embodiments of our methods for diffusion coating an alloy containing at least 5 wt. % iron, it should be distinctly understood that our invention is not limited thereto, but may be variously embodied within the scope of following claims.

We claim:

1. A method of diffusion coating a surface of an alloy product containing at least 5 wt. %/o iron to obtain a coating of at least 10 mils and containing at least 30% chromium comprising:

a. preparing a powder mixture containing a chromium source in an amount providing greater than 15 wt. % chromium in the mixture, a silicon source in an amount to provide a chromium to silicon ratio of at least 10:1 and a dual activator containing 0.5 wt. % to 2 wt. % of a fluoride salt and 0.5 wt. % to 2 wt. % of ammonium chloride; and b. heating the powder mixture at a temperature of at least 2050° F. to cause the ammonium chloride to decompose forming a reducing environment containing hydrogen molecules and to allow chromium and silicon to diffuse onto the surface of the iron-containing alloy product forming a chromium silicon coating.

2. The method of claim 1 wherein the powder mixture is heated to a temperature of from 2050° F. to 2200° F.

3. The method of claim 1 wherein the chromium source is at least one ferro-chromium alloy.

4. The method of claim 1 wherein the silicon source is at least one ferro-silicon alloy.

5. The method of claim 1 wherein the coating is applied by pack cementation.

6. The method of claim 1 wherein the chromium and silicon diffuse by surface chemical vapor diffusion from at least one of a masteralloy-activator-filler composite sheet containing the powder mixture and a masteralloy-activator-filler composite insert containing the powder mixture.

7. The method of claim 1 wherein the fluoride salt is calcium fluoride.

8. The method of claim 1 wherein the powder mixture is comprised of 20 wt. % to 25 wt. % chromium, 1 wt. % to 3 wt. % silicon, 0.5 wt. % to 2 wt. % ammonium chloride, 0.5 wt. % to 2 wt. % calcium fluoride and the balance aluminum oxide filler.

9. The method of claim 1 wherein the diffusion mixture is comprised of 20 wt. % to 25 wt. % ferro-chromium, 1 wt. % to 3 wt. % ferro-silicon, 0.5 wt. % to 2 wt. % ammonium chloride, 0.5 wt. % to 2 wt. % calcium fluoride and the balance aluminum oxide filler.

10. A method of diffusion coating a surface of an alloy product containing at least 5 wt. % iron comprising:

a. preparing a powder mixture containing a chromium source in an amount providing greater than 15 wt. % chromium in the mixture, a silicon source in an amount to provide a chromium to silicon ratio of at least 10:1 and a dual activator containing 0.5 wt. % to 2 wt. % of a fluoride salt and 0.5 wt. % to 2 wt. % of a chloride salt at least one of those salts being an ammonium halide salt; and b. heating the powder mixture at a temperature of at least 1950° F. to cause the ammonium chloride to decompose forming a reducing environment containing hydrogen molecules and to allow chromium and silicon to diffuse onto the surface of the iron-containing alloy product forming a chromium silicon coating.

11. The method of claim 10 wherein the chromium source is at least one ferro-chromium alloy.

12. The method of claim 10 wherein the silicon source is at least one ferro-silicon alloy.

13. The method of claim 6 wherein the coating is applied by pack cementation.

14. The method of claim 10 wherein the heating occurs and the chromium and silicon diffuse by surface chemical diffusion from at least one of a masteralloy-activator-filler composite sheet containing the powder mixture and a masteralloy-activator-filler composite insert containing the powder mixture.

15. The method of claim 10 wherein the fluoride salt is calcium fluoride.

16. The method of claim 10 wherein the diffusion mixture is comprised of 20 wt. % to 25 wt. % chromium, 1 wt. % to 3 wt. % silicon, 0.5 wt. % to 2 wt. % ammonium chloride, 0.5 wt. % to 2 wt. % calcium fluoride and the balance aluminum oxide filler.

17. The method of claim 10 wherein the diffusion mixture is comprised of 20 wt. % to 25 wt. %) ferro-chromium, 1 wt. % to 3 wt. % ferro-silicon, 0.5 wt. % to 2 wt. % ammonium chloride, 0.5 wt. % to 2 wt. % calcium fluoride and the balance aluminum oxide filler.

* * * * *